United States Patent [19]

Eichinger et al.

[11] 4,278,027

[45] Jul. 14, 1981

[54] RESILIENT RAILWAY TRUCK DOUBLE AXLE DRIVE

[75] Inventors: Johann Eichinger, Vaterstetten; Julius Huebl, Munich, both of Fed. Rep. of Germany

[73] Assignee: Carl Hurth Maschinen- und Zahnradfabrik, Munich, Fed. Rep. of Germany

[21] Appl. No.: 99,964

[22] Filed: Dec. 3, 1979

[30] Foreign Application Priority Data

Dec. 13, 1978 [DE] Fed. Rep. of Germany ..... 2853839

[51] Int. Cl.[3] ..... B61C 9/44; B61C 9/52; B61F 3/04

[52] U.S. Cl. ..... 105/131; 105/117; 105/135; 105/136

[58] Field of Search ..... 105/131, 135, 136, 117

[56] References Cited

U.S. PATENT DOCUMENTS

| | | | |
|---|---|---|---|
| 3,453,971 | 7/1969 | Ishizawa | 105/131 |
| 3,859,929 | 1/1975 | Korn et al. | 105/136 X |

FOREIGN PATENT DOCUMENTS

| | | | |
|---|---|---|---|
| 838452 | 5/1952 | Fed. Rep. of Germany | 105/131 |
| 2332281 | 1/1975 | Fed. Rep. of Germany | 105/131 |

*Primary Examiner*—Joseph F. Peters, Jr.
*Assistant Examiner*—Howard Beltran
*Attorney, Agent, or Firm*—Blanchard, Flynn, Thiel, Boutell & Tanis

[57] ABSTRACT

A double axle drive for railway trucks of rail vehicles. The axis of rotation of the drive motor extends parallel to the longitudinal axis of the vehicle and extends between the wheel-set axles. The drive motor drives the wheel sets through a bevel gear arrangement. Each bevel gear arrangement has, on the driven side thereof, a hollow shaft which encircles the respective wheel-set axle. The hollow shaft is connected at its two ends through an elastic coupling to the wheel-set axles. The entire drive system is supported on the two axles through four couplings. Each of the four couplings is composed of rotation-symmetrical members, one being connected to the hollow shaft and the other to the axle, and an interconnecting flexible joint sleeve circumferentially spaced around the periphery of the two coupling halves.

19 Claims, 13 Drawing Figures

RESILIENT RAILWAY TRUCK DOUBLE AXLE DRIVE

FIELD OF THE INVENTION

The invention relates to a double axle drive for railway trucks of rail vehicles, in which the axis of rotation of the shaft of the motor extends parallel to the longitudinal axis of the vehicle between the wheel-set axles, the motor driving through a bevel gear arrangement, wherein each bevel gear arrangement has on the driven side thereof a hollow shaft which surrounds substantially concentrically the respective wheel-set axle, and which hollow shaft is connected at its two ends through an elastic coupling to the wheel-set axle, and wherein the entire drive system is supported through the four couplings on the two axles.

BACKGROUND OF THE INVENTION

Such drives, which are also identified as suspension drives, have been known for some time. German Pat. No. 838 452, for example, discloses a drive of the described type as its subject matter, in which the elastic coupling is formed of a rubber disk which surrounds the wheel-set axle and which is connected on one axial side thereof to a disk-shaped flange secured to the hollow shaft and on the other axial side thereof to a disk-shaped flange which is mounted on the wheel-set axle, for example by a vulcanizing process. All double axle drives of the above-described type are characterized by the elastic couplings not only having to transmit the torque but must also absorb the reaction moment of the motor and must resiliently carry the entire weight of the drive aggregate. In the construction of the elastic coupling, which is discussed here, the rubber is mainly stressed with respect to shear through the weight and the mass forces which occur during driving, namely in a plane, which lies perpendicularly with respect to the wheel-set axle. In order to prevent the drive system for sagging too much with respect to the wheel-set axle, the rubber disk must be relatively thin and hard. However, this increases the negative effects of the shearing stress and the spring action is further worsened in cross direction, thus in direction of the wheel-set axle. A further very important disadvantage is that during an exchange of the rubber disks, which exchange will become necessary, the wheels must be pulled off from the axles.

This disadvantage, which very much interferes with the operation, is avoided by coupling having split rubber or elastic elements, as it is known among others from German OS No. 23 32 281. A hub which is mounted on the hollow shaft and one which is mounted on the wheel-set axle have a plurality of radially outwardly extending arms, which are arranged alternately lying one behind the other and a rubber block being inserted between each two arms. The rubber blocks can be removed individually radially outwardly and can be installed from outside without requiring a removal of the wheels from the axles. This type of coupling is very stiff in the plane which is positioned perpendicularly with respect to the wheel-set axle. In cross direction, it is softer than the construction utilizing the rubber disks, however, the rubber blocks are exposed to a shearing stress. Further disadvantages are the complicated shape of the coupling arms and the resulting machining difficulties and the fact that the rubber blocks receive their initial tension not before the installation, which makes the installation and the demounting more difficult.

Therefore, the basic purpose of the invention is to provide a double axle drive of the above-described type, which does not have the mentioned disadvantages, thus is easy to manufacture and easy to service, and the rubber or elastic elements of which are exposed to no shearing stresses at all or only small shearing stresses.

The purpose is attained by providing a construction for the elastic couplings, wherein with each two coupling halves, one is mounted on the hollow shaft of the gearing arrangement, the other one on the wheel-set axle and both are constructed substantially as rotation-symmetrical members and are connected through circumferentially arranged flexible joint sleeves. For a balanced operating behavior, at least three flexible joint sleeves are needed in each coupling; since the sleeves, however, are, as much as possible, no to be stressed for shear, there should be no less than six flexible joint sleeves in each coupling. Because of the star-shaped arranged rubber or elastic joints, such couplings are also identified as "star coupling".

The connection of the two coupling halves through the flexible joint sleeves can occur so that the one coupling half has radially outwardly directed pins, which receive the flexible joint sleeves in their openings, while the other coupling half is provided with openings, in which the flexible joint sleeves are received on their outer sleeve members.

Various preferable construction possibilities exist for the design of the flexible joint sleeves. Thus it is for example possible to vulcanize in the simplest form a rubber or elastic ring between a metallic inner part and an outer part, which rubber or elastic ring is adjusted in its cross section to the respective operating conditions and material characteristics. To further reduce the shear stress, it is possible for two rubber or elastic rings, with a metallic intermediate ring, surrounding one another concentrically to be vulcanized between an inner part and an outer part. In order to make the coupling stiff in one plane, for example in circumferential direction and in transverse direction thereto, thus in direction of the wheel-set axle, but to permit a soft deflection of the coupling, recesses or openings at certain points in the rubber or elastic rings are advantageous. In order that the tensile stresses which occur during the deflection in the rubber or elastic rings do not lead to a removal of the rubber or elastic rings from the metal parts, the rubber or elastic rings are to be vulcanized in place under initial tension. The initial tension can be increased, when the outer and, if desired, intermediate ring are divided in the area of the openings in longitudinal direction such that they have a semicircular-shaped cross section and are arranged at a radial distance from one another, which corresponds with the desired initial tension. The flexible joint sleeve assumes the round cross section only in the installed condition. The installation process can thereby be made easier, when the flexible joint sleeve is received in an intermediate sleeve. The coupling halves which receive the flexible joint sleeves at their outer sleeve members are divided advantageously in such a manner that the flexible joint sleeves are received on half of the periphery of their surfaces by the actual coupling half and on the other half of their periphery by a ring or the like which is connected to the coupling half. Installation and service works are made easier if the ring is again divided transversely with respect to its axis into two semicircular rings or if in place of a ring which receives all flexible joint sleeves several bearing brackets are provided which are secured to the coupling half. The arrangement of the coupling on both ends of a hollow shaft can be done in such a manner that both couplings are angularly spaced at the same angle from one another or, however, so that they are offset against one another at half the angle between the two flexible joint sleeves.

A double axle drive according to the invention offers with respect to the known construction a whole series of advantages, namely:

The rubber joints are stressed by the torque to be transmitted and by the weight of the motor-gearing-aggregate substantially for pressure and only little for shear.

The exchanging of individual elastic joints can be done without dismantling of the railway truck and without dismantling of the motor, gearing arrangement and/or axles and wheel sets.

At an angular deflection only small return forces occur, which assures a great safety against derailment.

The return forces can be adjusted to the requirements through a suitable design of the elastic joints.

BRIEF DESCRIPTION OF THE DRAWINGS

The invention is discussed below with reference to exemplary embodiments which are illustrated in FIGS. 1 to 13.

In the drawings.

DETAILED DESCRIPTION

Figure 1:
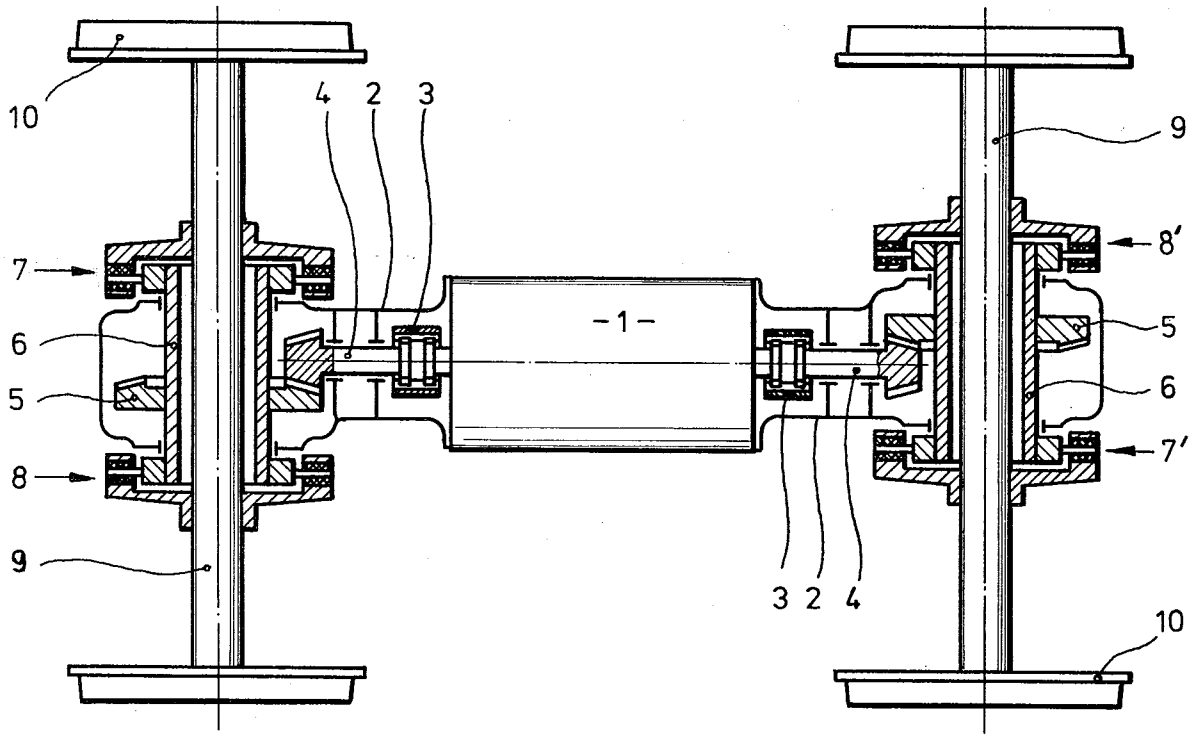
FIG. 1 is a top view, partially sectioned, of a simplified embodiment of a double axle drive.

A bevel pinion gear 4A is connected to each output shaft of a double output shaft drive motor 1, the axis of rotation of which extends parallel to the longitudinal axis of a railway truck not illustrated, the housing for the bevel pinion gear being identified by the reference numeral 2. The transmission of power from the motor onto the pinion gear shaft 4 of the gear arrangement occurs through a suitable coupling 3, for example a gear coupling for balancing of angle deviations and axis misalignments between the motor and the gear arrangement, which deviations and misalignments are caused by the manufacturing process. The pinion gear 4A engages a bevel gear 5 fixedly secured against a relative rotation on a hollow shaft 6, for example by a threaded connection and pinning on a flangelike enlargement of the hollow shaft, The hollow shaft 6 is—just as with the pinion gear shaft 4—rotatably supported by conventional and therefore not illustrated means; however, it is not axially movably supported in the housing 2. The hollow shaft extends laterally in both directions from the axis of the pinion shaft 4 and enough out of the housing 2 in order to be able to facilitate a fixed mounting of first coupling halves 11 of linkage couplings 7,8 thereto, which first coupling halves are fixed against a relative rotation and an axial movement. Details of the coupling will be described below. Associated second coupling halves are mounted, also fixed against a relative rotation and an axial movement on a wheel-set axle 9. The wheel-set axle extends through the hollow shaft 6 and carries on its axial ends drive wheels 10 of the rail vehicle. In the unloaded condition, there exists so much radial play between the inside wall of the hollow shaft 6 and the surface of the wheel-set axle as is needed for the requirements of the elasticity of the drive system, particularly in consideration of its weight and the mass acceleration which occurs during driving on the one hand and the resiliency possibilities of the flexible joint or elastically yieldable sleeve on the other hand, and the addition of a certain safety factor. The mounting of the wheel set in the railway truck is not illustrated, just as a disk brake which is arranged if desired between a flexible joint coupling on each wheel-set axle and the adjacent drive wheel 10 is not illustrated. These elements are known and are of no importance for the invention.

Details of the linkage coupling 7,8; 7',8' can be taken from FIGS. 2 to 5. A first coupling half 11 is fixedly mounted against rotation and an axial movement, for example by a forced fit on the hollow shaft 6 shown in FIG. 2. Hollow pins 12 extend radially outwardly from the first coupling half 11 or hub, which pins 12 are fastened to the hub by screws 13 and washers 14. The outer free ends of the pins 12 are received in openings 16 in flexible joint or elastically yieldable sleeves 15. The flexible joint sleeves, which will be discussed in more detail below, are each prevented also by the screws 13 and washers 14 from shifting in direction of their axis. The outer sleeve members 17 of the flexible joint sleeves are received in radially outwardly directed openings 18 of a second coupling half 19. The second coupling halves 19 are fixedly mounted against a relative rotation and an axial movement on the wheel-set axle 9, for example by a forced fit. The first and second coupling halves 11,19 are substantially rotation-symmetrical parts, which are axially aligned to one another. The portion of the second coupling half 19, which portion has the openings 18 therein, at least partially overlaps the first coupling half 11.

In the case of each linkage coupling 7,8, at least three such starlike arranged flexible joint or elastically yieldable sleeves 15 are required in order to prevent a large part of the weight of the drive aggregate and the mass acceleration during driving to act as a thrust load on the elastic elements. A thrust load leads to the removal of the elastic material, as rubber, from the metal parts and to a quick destruction of the elastic or rubber elements themselves. In order to prevent as much as possible a thrust load application, at least six flexible joint sleeve per coupling 7,8 are used. For a smooth run of the drive system, the two couplings 7,8 for a wheel-set axle are arranged either so that the flexible joint sleeves each have the same position or that the flexible joint sleeves of the one coupling are angularly offset at half the angle which is defined by two adjacent flexible joint sleeves with respect to the other coupling.

Figure 4:
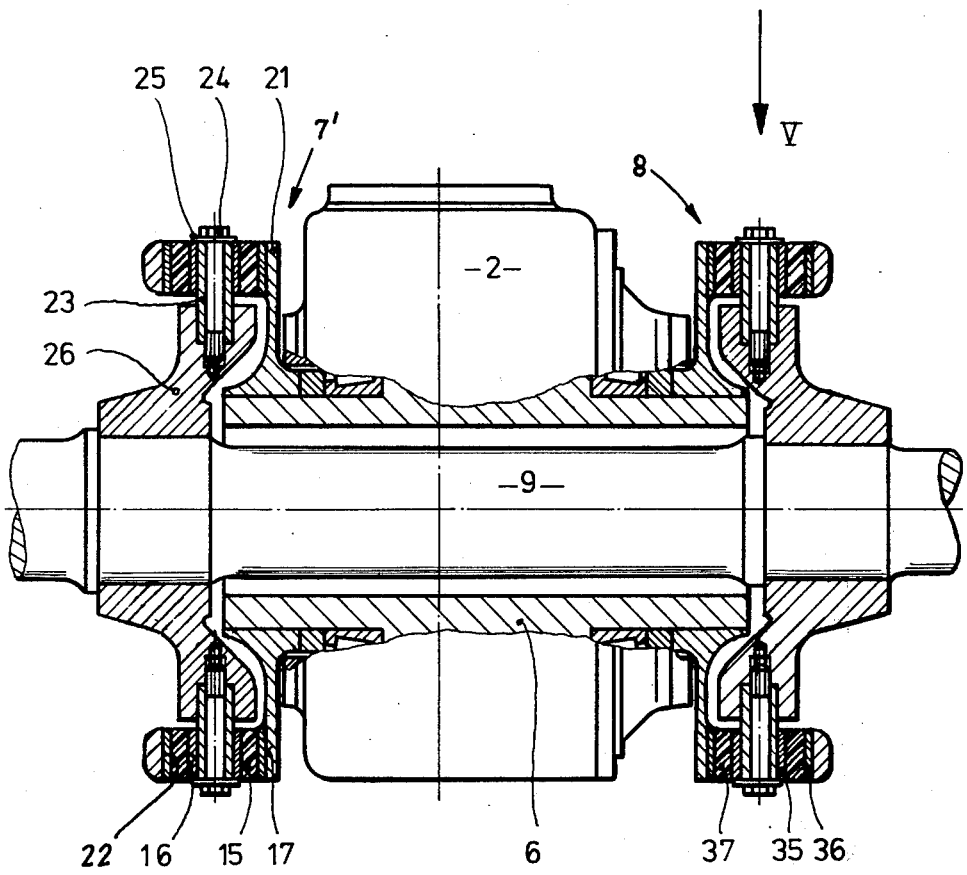
FIG. 4 is a longitudinal cross-seectional view of a different embodiment of the couplings.

A different arrangement of the flexible joint sleeves 15 is illustrated in FIG. 4, wherein the two linkage couplings 7',8' are identified. A first coupling half 21 is fixedly mounted against a relative rotation and an axial movement on the hollow shaft 6, for example by a forced fit. The sleeve members 17 of the flexible joint or elastically yieldable sleeves 15 are received in circumferentially arranged openings 22. Radially inwardly extending hollow pins 23 are received in the central openings 16 through the flexible joint sleeves, which pins 23 are secured by means of screws 24 and washers 25 to a second coupling half 26. The screws 24 and washers 25 serve simultaneously for holding the flexible joint sleeves in place. The coupling half 26 is fixedly arranged against a relative rotation and an axial movement on the wheel-set axle 9. Both coupling halves are here too substantially rotation-symmetrical parts, which are arranged in axial alignment to one another. The portion of the first coupling half 21, which portion carries the flexible joint sleeves 15, at least partially overlaps the second coupling half 26.

Figure 3:
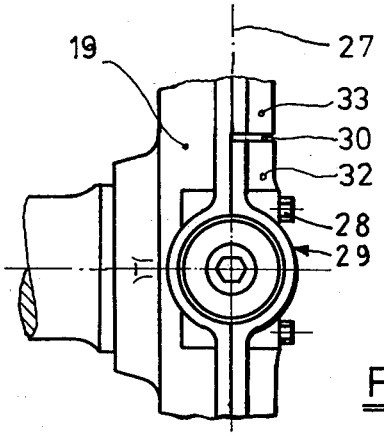
FIG. 3 is a fragmentary view corresponding with the arrow III of FIG. 2.

To make the installation and removal easier, the coupling half 19,21 which receives the sleeve member 17 of the flexible joint sleeves 15 therein, is divided approximately in the plane of rotation 27 of the axis of the flexible joint sleeves (FIG. 3). The openings 18 are thus each formed half by the actual coupling half 19 and a ring 29 or the like, which is secured by screws 28 thereto. A further simplification is achieved by the ring 29 being divided transversely to its axis, so that two ring halves 32 and 33 are created. The split or gap is identified by the reference numeral 30 in FIG. 3.

Figure 2:
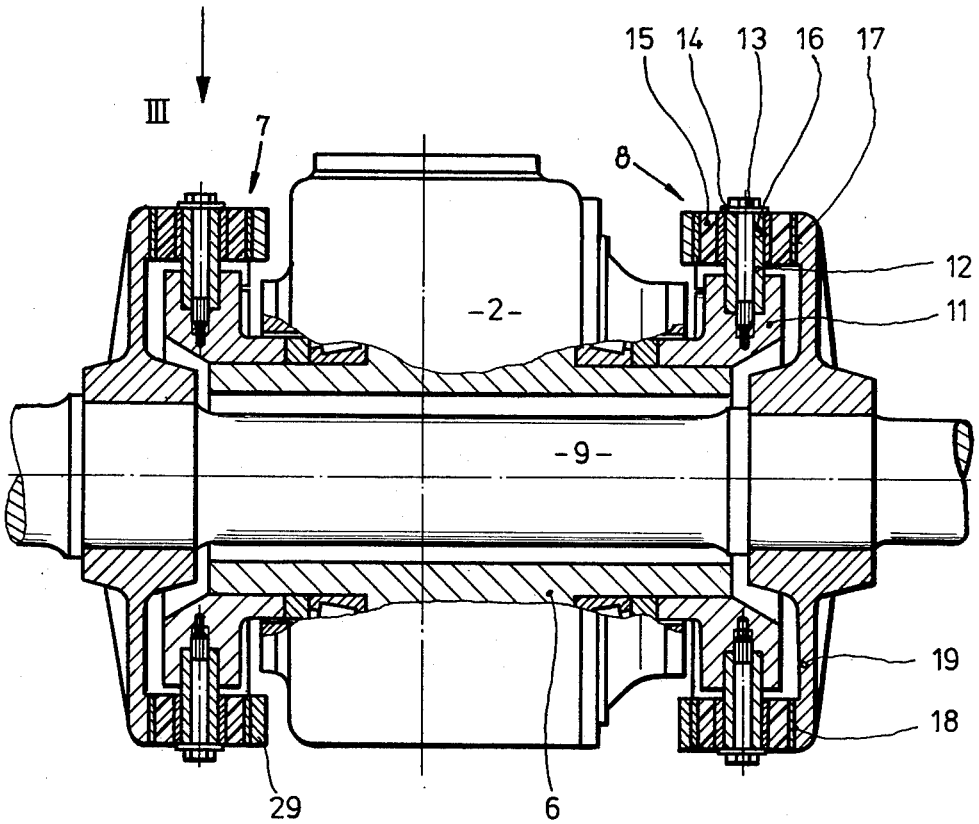
FIG. 2 is a longitudinal cross-sectional view of the couplings of the gearing arrangement illustrated in FIG. 1 in an enlarged scale.
Figure 5:
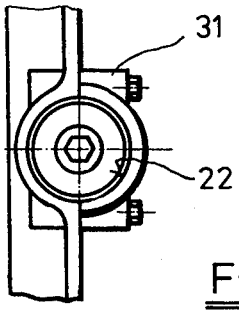
FIG. 5 is a fragmentary view corresponding with the arrow V of FIG. 4.

In place of one ring or two ring halves, it is also possible to use bearing brackets 31. The arrangement of a bearing bracket 31 is illustrated in FIG. 5. Thus, each flexible joint sleeve 15 can be exchanged individually without having to loosen the mounting of adjacent sleeves. However, this arrangement can also be used in the exemplary embodiment according to FIG. 2, just as a ring or a split ring can be used in the example of use according to FIG. 4. It has already been mentioned that various advantageous possibilities exist for the design of the flexible joint sleeves 15. FIGS. 2 and 4 illustrate the simplest form of a flexible joint sleeve. It consists of a metallic inner part 35, an outer part 36 and a rubber or elastic material ring 37 which is vulcanized thereto and therebetween and which is under initial tension. The material characteristics and dimensions are adjusted to the respective operating conditions, just as the profile of the elastic or rubber ring, which may for example be rectangular-shaped or can have arced or double-sloped or the like boundary lines.

Figure 6:
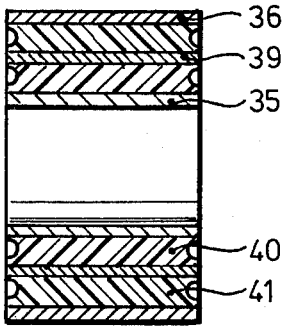
FIG. 6 is a longitudinal cross-sectional view of a different embodiment of the flexible joint sleeves in an enlarged scale.

FIG. 6 illustrates a different form in which the shearing stress which occurs in the rubber or elastic material is kept very low due to the division of the rubber or elastic ring into two components: The flexible joint sleeve of FIG. 6 consists of a metallic cylindrical inner part 35, an intermediate cylindrical part 39, an outer cylindrical part 36 and a rubber or elastic material ring 40,41 which is vulcanized between the inner part and the intermediate part and between the intermediate part and the outer part, respectively, and is under initial tension. Here too material characteristics and dimensions are adjusted to the respective operating conditions.

Figure 7:
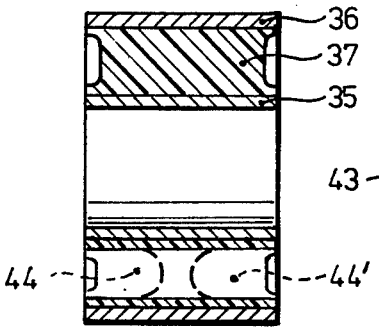
FIGS. 7 to 12 illustrate further embodiments of the flexible joint sleeves each in a longitudinally cross-sectioned and in an end view.
Figure 8:
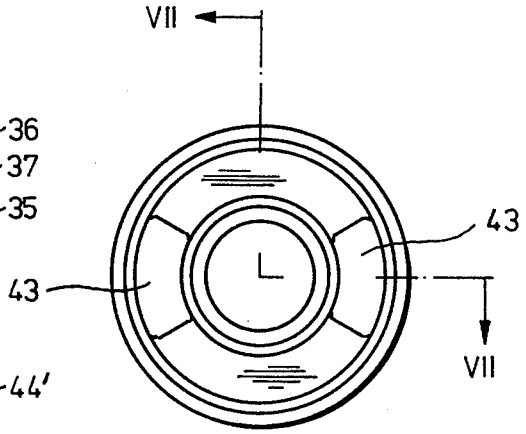

In order to make the coupling as stationary as possible in the peripheral direction, however, soft or flexible in the transverse direction to facilitate the absorption of the angular displacements between the hollow shaft and wheel-set axle, which occur during travel over switches and rail unevenesses, the sleeves according to FIGS. 7 and 8 can be provided, in the area which acts in direction of the wheel-set axle, with openings 43 which extend from one front side to the other. In some cases, recesses 44,44', which extend from the front sides axially inwardly, are also sufficient. The cross section of the openings or of the recesses influences the stiffness of the coupling and can be chosen corresponding with the respective requirements. It is not limited to the illustrated example.

Figure 9:
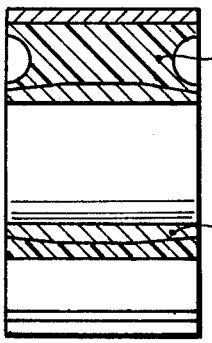
Figure 10:
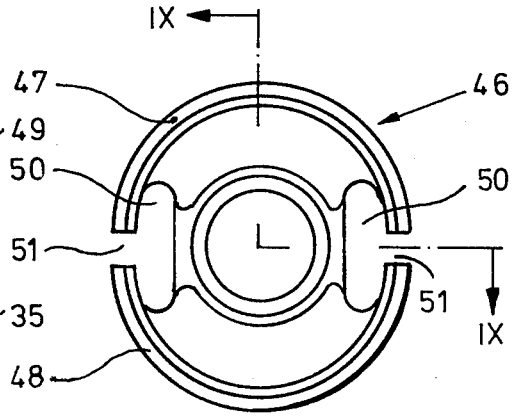
Figure 13:
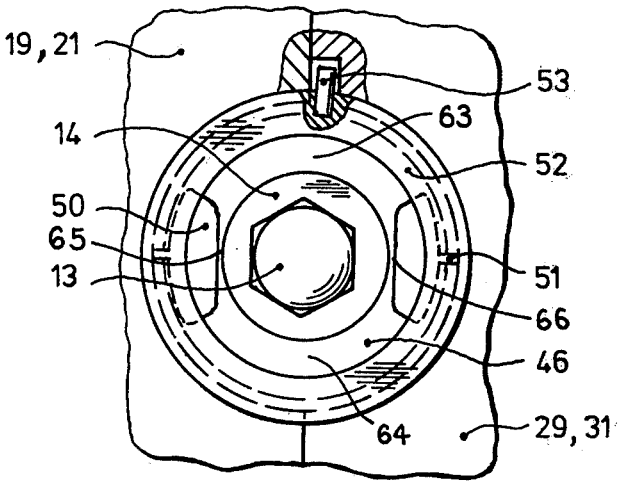
FIG. 13 illustrates the flexible hinge sleeve according to FIGS. 9 and 10 in an installed condition.

The rubber or elastic rings 37,40,41 are always vulcanized in position under initial tension between the sleeve parts which surround them. The permissible tensile stress which acts onto the rubber or elastic rings depends on the magnitude of the initial tension. However, the initial tension is limited due to manufacturing reasons. It can be increased if the outer part and, if desired, the intermediate part of the flexible joint sleeve is divided. A simple sleeve 46 is shown in FIGS. 9 and 10. A rubber or elastic part 49 is vulcanized in position between the matallic inner part 35 and the metallic outer part which consists of two halves 47,48 having an approximate semicircular-shaped cross section. This rubber or elastic part has, near the outer part, openings 50, in the area of which lie the separating gaps 51 between the two outer part halves. The flexible joint sleeve, which is oval because of the separating gaps 51, attains an approximate circular cross section only in the installed condition (FIG. 13) due to a closing of these gaps. As a result, the installation into the linkage coupling becomes substantially easier, when the sleeve 46 is inserted into a cylindrical sleeve 52.

Figure 11:
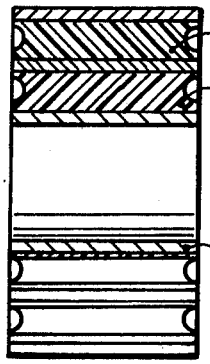
Figure 12:
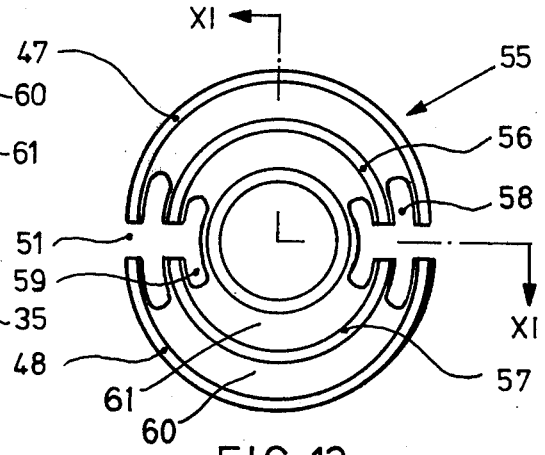

FIGS. 11 and 12 illustrate also a flexible joint sleeve 55, which is similar to FIG. 6 in construction, with an intermediate part and two rubber or elastic parts, wherein, however, both the outer part (47,48) and also the intermediate part (56,57) are divided into two halves. Due to the openings 58,59 in the rubber or elastic parts 60,61, the outer rubber or elastic part 60 is separated into two unconnected parts.

As mentioned above, the openings 43,50,58 are arranged in a certain position in the coupling: the full material cross section 63,64 (FIG. 13) is effective in peripheral direction of the coupling, in transverse direction, the cross section 65,66 which is reduced by the openings 43,50,58. Therefore, for fixation of the flexible joint sleeves in the correct position in the outer part 36,47, a pin 53 is provided, which projects into a groove 67 or the like in the ring 29 or in the bearing bracket 31.

The invention is not limited to the described example of use which has been illustrated in the drawings. For example, other gearing arrangements are possible, for example with a further gearing step, or the parts of the linkage coupling are designed differently, etc. The patent protection is to include such variations.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A double axle drive for rail vehicles, comprising:
rotatably supported first and second longitudinally spaced transversely wheeled axles;

a rotatably supported hollow shaft surrounding each axle;

a drive motor located between said axles having a drive shaft at respective ends;

gear means between each of said drive shafts and said hollow shafts at the respective ends of said motor to rotate said hollow shafts upon rotation of said drive shafts;

elastic coupling means connected adjacent each end of said hollow shaft to each first and second axle to rotate each of said axles, said elastic coupling means comprising at least three equidistant circumferentially spaced pin means secured to one of said hollow shaft and said axle with the axes thereof projecting radially, means defining at least three equidistant circumferentially spaced openings in the other of said hollow shaft and said axle, the axis of each opening extending radially, each of said openings receiving a pin means therein so that the axes thereof are colinear, the size of said pin means being smaller than the size of said opening to define a space therebetween, an elastically yieldable sleeve means received in said space between said pin means and the interior wall of said opening, said sleeve means being fixedly secured to said pin means and said interior wall of said opening.

2. The double axle drive according to claim 1, wherein said pin means are secured to said hollow shaft and said openings are provided in an annular coupling member on said axle.

3. The double axle drive according to claim 1, wherein said pin means are secured to said axle and said openings are provided in an annular coupling member on said hollow shaft.

4. The double axle drive according to claims 1, 2, or 3, wherein at least six pin means and six openings are provided, each pin means and corresponding opening having an operatively connected elastically yieldable sleeve means.

5. The double axle drive according to claim 1, wherein said elastically yieldable sleeve means consists of a metallic inner part, a metallic outer part and an elastic ring vulcanized therebetween which elastic ring is under initial tension, the cross section of which elastic ring is adjusted to the respective operating conditions and the material characteristics.

6. The double axle drive according to claim 1, wherein said elastic coupling means are arranged at opposite ends of said hollow shaft and are positioned at the same angle position with respect to one another.

7. The double axle drive according to claim 1, wherein said elastic coupling means are arranged on opposite ends of said hollow shaft and are angularly offset against one another at half the angle which is defined by two mutually adjacent elastically yieldable sleeve means.

8. The double axle drive according to claim 1, wherein said elastic coupling means includes an annular coupling member, said coupling member including recess means therein receiving approximately one half of said elastically yieldable sleeve means therein, wherein the other half of said elastically yieldable sleeve means is engaged by a bearing bracket secured to said coupling member.

9. The double axle drive according to claim 1, wherein said elastic coupling means includes an annular coupling member divided in the rotation plane formed by the axes of said elastically yieldable sleeve means into first and second halves, such that said elastically yieldable sleeve means are engaged approximately on one half of the periphery thereof by said first half and approximately on the other half of the periphery by said second half which is secured to said first half.

10. The double axle drive according to claim 9, wherein said second half is a ring divided in direction transversely to its axis for forming two parts, each of which is secured to said first half.

11. The double axle drive according to claim 1, wherein said elastically yieldable sleeve means consists of a metallic inner part, a metallic intermediate part, a metallic outer part and a first elastic ring vulcanized between the inner and intermediate parts and a second elastic ring vulcanized between the intermediate and outer parts, both of said first and second elastic rings being under initial tension, and wherein the cross sections of said elastic rings are adjusted to the respective operating conditions and material characteristics.

12. The double axle drive according to claim 5, wherein said elastic ring is provided with at least one of recesses which extend from the axial ends inwardly and openings which extend from one axial end to the other.

13. The double axle drive according to claim 12, wherein said recesses and openings are limited to the sections of the ring surfaces which are effective in direction of the wheeled axle upon stress of said elastic coupling means, and the sections of the annular surfaces, which sections are effective in peripheral direction upon stress of said elastic coupling means, have the full cross section.

14. The double axle drive according to claim 12, wherein at least said outer part is divided in longitudinal direction at two oppositely lying points in the region of said openings to form two outer part halves, wherein said two outer part halves have a semicircular-shaped cross section and are aranged with a peripheral spacing therebetween, such that said elastically flexible sleeve means assume only in an installed condition a substantially circular cross section.

15. The double axle drive according to claim 14, including a cylindrical sleeve and wherein said elastically yieldable sleeve means are received in a cylindrical sleeve.

16. The double axle drive according to claim 11, wherein said first and second elastic rings are provided with at least one of recesses which extend from the axial ends inwardly and openings which extend from one axial end to the other.

17. The double axle drive according to claim 16, wherein said recesses and openings are limited to the sections of the ring surfaces which are effective in direction of the wheeled axle upon stress of said elastic coupling means, and the sections of the annular surfaces, which sections are effective in peripheral direction upon stress of said elastic coupling means, have the full cross section.

18. The double axle drive according to claim 16, wherein at least said outer part is divided in longitudinal direction at two oppositely lying points in the region of said openings to form two outer part halves, wherein said two outer part havles have a semicircular-shaped cross section and are arranged with a peripheral spacing therebetween, such that said elastically flexible sleeve means assume only in an installed condition a substantially circular cross section.

19. The double axle drive according to claim 18, including a cylindrical sleeve and wherein said elastically yieldable sleeve means are received in a cylindrical sleeve.

* * * * *